US008387967B2

(12) United States Patent
Bischoff et al.

(10) Patent No.: US 8,387,967 B2
(45) Date of Patent: Mar. 5, 2013

(54) APPARATUS AND METHOD FOR HANDLING STACKS OF PRINTING MEDIA

(75) Inventors: Martin Bischoff, Hilgermissen (DE); Harald Freudenberg, Marklohe (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 108 days.

(21) Appl. No.: 12/857,650

(22) Filed: Aug. 17, 2010

(65) Prior Publication Data

US 2011/0062658 A1 Mar. 17, 2011

(30) Foreign Application Priority Data

Sep. 11, 2009 (DE) ..... 10 2009 040 918

(51) Int. Cl.
*B65H 5/22* (2006.01)

(52) U.S. Cl. ..... 271/3.06; 271/3.02; 271/3.07; 271/146; 271/210

(58) Field of Classification Search ..... 271/3.02, 271/3.05–3.07, 105, 241, 210, 146, 283, 271/284; 414/788.8, 788.9; 156/566–572
See application file for complete search history.

(56) References Cited

U.S. PATENT DOCUMENTS

| | | | | |
|---|---|---|---|---|
| 4,014,537 | A | 3/1977 | Stange | |
| 4,130,207 | A * | 12/1978 | Cogswell et al. | 414/789 |
| 4,699,371 | A * | 10/1987 | Ettischer et al. | 271/99 |
| 5,116,303 | A * | 5/1992 | Dietrich et al. | 493/313 |
| 5,203,953 | A * | 4/1993 | Focke et al. | 156/566 |
| 5,290,391 | A | 3/1994 | Czech et al. | |
| 5,499,805 | A * | 3/1996 | Anma | 271/3.05 |
| 6,095,512 | A * | 8/2000 | Vijuk et al. | 271/3.05 |
| 6,364,312 | B1 * | 4/2002 | Ramcke | 271/299 |
| 6,592,116 | B2 * | 7/2003 | Focke et al. | 271/9.08 |
| 7,234,696 | B2 * | 6/2007 | Focke et al. | 271/185 |
| 7,637,711 | B2 * | 12/2009 | Wronski et al. | 414/793 |
| 7,644,916 | B2 * | 1/2010 | Spatafora | 271/101 |
| 2002/0121736 | A1 * | 9/2002 | Kaya et al. | 271/210 |
| 2007/0296140 | A1 * | 12/2007 | Babanats et al. | 271/146 |

FOREIGN PATENT DOCUMENTS

| | | | |
|---|---|---|---|
| DE | 23 21 771 | A | 11/1974 |
| DE | 78 11 113 | U1 | 9/1978 |
| DE | 34 43 735 | A1 | 6/1986 |
| DE | 40 03 153 | A1 | 8/1991 |
| DE | 40 27 247 | A1 | 8/1991 |
| DE | 44 10 838 | A1 | 10/1994 |
| DE | 100 07 089 | A1 | 8/2001 |
| DE | 102 57 598 | A1 | 6/2004 |
| DE | 102006001800 | | 7/2007 |
| EP | 1062883 | | 12/2000 |
| EP | 1 593 624 | A1 | 11/2005 |
| WO | WO 90/09925 | | 9/1990 |

* cited by examiner

*Primary Examiner* — Jeremy R Severson
(74) *Attorney, Agent, or Firm* — Laurence P. Colton; Smith Risley Tempel Santos LLC

(57) ABSTRACT

An apparatus for handling stacks (18) of printing media (11) which are arranged above one another and are made from packaging material, in particular a magazine (16) for excise stamps, coupons or the like, preferably within an apparatus for producing packs (10) for cigarettes, having a shaft (19) for receiving the stack (18), which shaft (19) is delimited at least partially by preferably stationary walls (20) and is, in particular, upright. The shaft (19) can have at least one suction device (25) which acts in regions on the stack (18) in order to hold and/or align the printing media (11) on the wall (20) by means of vacuum.

14 Claims, 3 Drawing Sheets

APPARATUS AND METHOD FOR HANDLING STACKS OF PRINTING MEDIA

STATEMENT OF RELATED APPLICATIONS

The present invention is based on and claims the benefit of German Patent Application No. 10 2009 040 918.1 having a filing date of 11 Sep. 2009, which is incorporated herein in its entirety by this reference.

BACKGROUND OF THE INVENTION

1. Technical Field

The invention relates to an apparatus for handling stacks of printing media which are arranged above one another and are made from packaging material, in particular a magazine for excise stamps, coupons or the like, preferably within an apparatus for producing packs for cigarettes, having a shaft for receiving the stack, which shaft is delimited at least partially by preferably stationary walls and is, in particular, upright. Furthermore, the invention relates to a corresponding method.

2. Prior Art

Apparatuses of this type are known, for example, from practice in the form of magazines for stacks of excise stamps for cigarette packs in different embodiments. As a rule, the excise stamps are fed from above into an upright shaft of the magazine and are removed individually from the underside of the said stack, and are fed to a cigarette pack and are fastened to the latter.

Firstly, a problem here is the alignment of the excise stamps in the shaft and also the removal in the region of the underside of the said shaft. In order for it to be possible to separate the excise stamps reliably, it is often required to reduce the height of the stack, in order to reduce the friction between the excise stamps which lie on one another. Otherwise, there is the risk that a plurality of printing media are removed in one go from the stack and disruptions occur in the subsequent processing. With regard to the alignment of the excise stamps, it is to be noted that they partially have different dimensions as a result of manual processing. In order to ensure a positionally accurate transfer to the cigarette packs, an alignment of the excise stamps is therefore indispensable.

BRIEF SUMMARY OF THE INVENTION

Proceeding from this, the invention is based on the object of developing the apparatuses and methods known from the prior art, in particular with regard to avoiding the abovementioned problems.

An apparatus for achieving the object is an apparatus for handling stacks of printing media which are arranged above one another and are made from packaging material, in particular a magazine for excise stamps, coupons or the like, preferably within an apparatus for producing packs for cigarettes, having a shaft for receiving the stack, which shaft is delimited at least partially by preferably stationary walls and is, in particular, upright, characterized in that the shaft has at least one suction device which acts in regions on the stack in order to hold and/or align the printing media on the wall by means of vacuum. Accordingly, there is provision for the shaft to have at least one suction device which acts in regions on the stack in order to hold and/or align the printing media on the wall by means of vacuum.

It has been shown surprisingly that the loading of the stack with vacuum in the way described leads to the air being sucked out between the printing media and the stack being compressed in this region. Furthermore, the printing media are pulled against the wall here and in this way are aligned on the wall. In addition, that region of the stack which is gripped by the vacuum is held on the wall, with the result that that region of the stack which is situated under it is relieved, which facilitates the correct separation of the printing media out of the stack. In this way, several problems which exist in the prior art are solved at the same time.

There is provision in one preferred refinement of the invention for the suction device to be assigned to a wall of the shaft, in particular in such a way that at least one opening is provided in the wall, which opening is connected to a vacuum source and via which opening the stack can be loaded with a vacuum in the region of the opening.

One advantageous development of the invention provides for the wall to have two suction devices which are spaced apart from one another and can be actuated alternately by means of a controller. In this way, the stack can be held firmly and aligned at different heights with corresponding relief of the stack which lies underneath.

The printing media are preferably arranged in the stack so as to lie flatly on one another, with the result that edges of the printing media face the at least one wall of the shaft, as a result of which the suction action of the suction device acts on the edge of the printing media.

There is provision in one preferred development of the invention for the shaft to have at least two walls which are arranged transversely with respect to one another, and for at least one suction device to be provided on both walls. This solution makes it possible to align the stack in two directions.

Another development of the invention described in the introduction, which can also be an independent solution of the object, is an apparatus for handling stacks of printing media which are arranged above one another and are made from packaging material, in particular a magazine for excise stamps, coupons or the like, preferably within an apparatus for producing packs for cigarettes, having a shaft for receiving the stack, which shaft is delimited at least partially by walls and is, in particular, upright, and having a conveying device for feeding the printing media to the shaft, characterized in that a measuring device is provided for detecting the height of the stack, and in that the speed of the conveying device can be regulated according to the height of the stack detected by the measuring device, in order to control the height of the stack. Accordingly, a measuring device is provided for detecting the height of the stack, it being possible for the speed of the conveying device to be regulated according to the height of the stack detected by the measuring device, in order to control the height of the stack (continuously or in a stepped manner).

In this way, a further problem in the prior art is solved, namely the feeding of the printing media to the shaft. Solutions known from practice provide for the conveying means for feeding the printing media to be stopped when a predefined stack height is reached. However, the solution according to the invention makes it possible to reduce or increase the conveying speed of the conveying means. In this way, no gaps in the conveying stream which could lead to disruptions are produced during the feeding of the printing media to the shaft. In the prior art, gaps in the conveying stream lead to printing media falling into the shaft in an uncontrolled manner and, as a result, to faulty positions of the printing media in the shaft which later disrupt the separation or removal.

There can be provision as a further measure for at least one region of a wall of the shaft to be of movable configuration for aligning the stack, the wall preferably being set in vibration by an oscillation device. As a result, an additional or alternative alignment of the printing media can be brought about, preferably in the upper region of the stack just after the feeding to the magazine. This development can also be an independent solution of the problem mentioned in the introduction.

There can be provision as a further measure for, in order to transfer the printing media from the conveying device to the shaft, a rotationally driven conveying means, in particular a conveying roll, to be arranged in the conveying path of the printing media, the conveying means being coupled to a drive of the conveying device. This development can also be an independent solution of the problem mentioned in the introduction.

According to one preferred development of the abovementioned concept, the conveying means can be assigned a further conveying means which is mounted so as to corotate, in particular a revolving roller, the printing media being conveyed through between the conveying means. The further conveying means counteracts the jamming of the printing media in the transition region between the conveying device and the shaft.

A further advantageous refinement provides for it to be possible for the conveying means to be brought into contact with one another by a spring device, the contact pressure being variable by adaptation of the spring device.

A method for achieving the object mentioned in the introduction is a method for handling stacks of printing media which are arranged above one another and are made from packaging material, in particular a magazine for excise stamps, coupons or the like, preferably within an apparatus for producing packs for cigarettes, having a shaft for receiving the stack, which shaft is delimited at least partially by preferably stationary walls and is, in particular, upright, characterized in that the printing media of the stack are held and/or aligned on the wall at least in regions by action of a vacuum on the corresponding printing media via a suction device which is assigned to the wall. Accordingly, there is provision for the printing media of the stack to be held and/or aligned on the wall at least in regions by action of a vacuum on the corresponding printing media via a suction device which is assigned to the wall.

According to one preferred development of the method according to the invention, the wall has a plurality of suction devices which are operated alternately.

One development of the method can be distinguished by the fact that the printing media are fed via a conveying device to the shaft, and by the fact that the height of the stack of the printing media in the shaft is detected by means of a measuring device, and the feed speed of the conveying device is regulated according to the height of the stack. The feed speed of the conveying device can be adapted continuously or in a stepped manner here.

In order to align the printing media within the stack, at least one wall of the shaft is preferably set in oscillation at least in regions.

BRIEF DESCRIPTION OF THE DRAWINGS

Further advantageous refinements otherwise result from the subclaims and the description. In the following text, one preferred exemplary embodiment will be described in greater detail using the drawing, in which:

DETAILED DESCRIPTION OF PREFERRED EMBODIMENTS

The equipment shown in FIGS. 1 to 6 is part of an apparatus for producing packagings for cigarettes. In the present case, this is in concrete terms the feeding and placing of printing media 11 on the packs 10.

Figure 1:
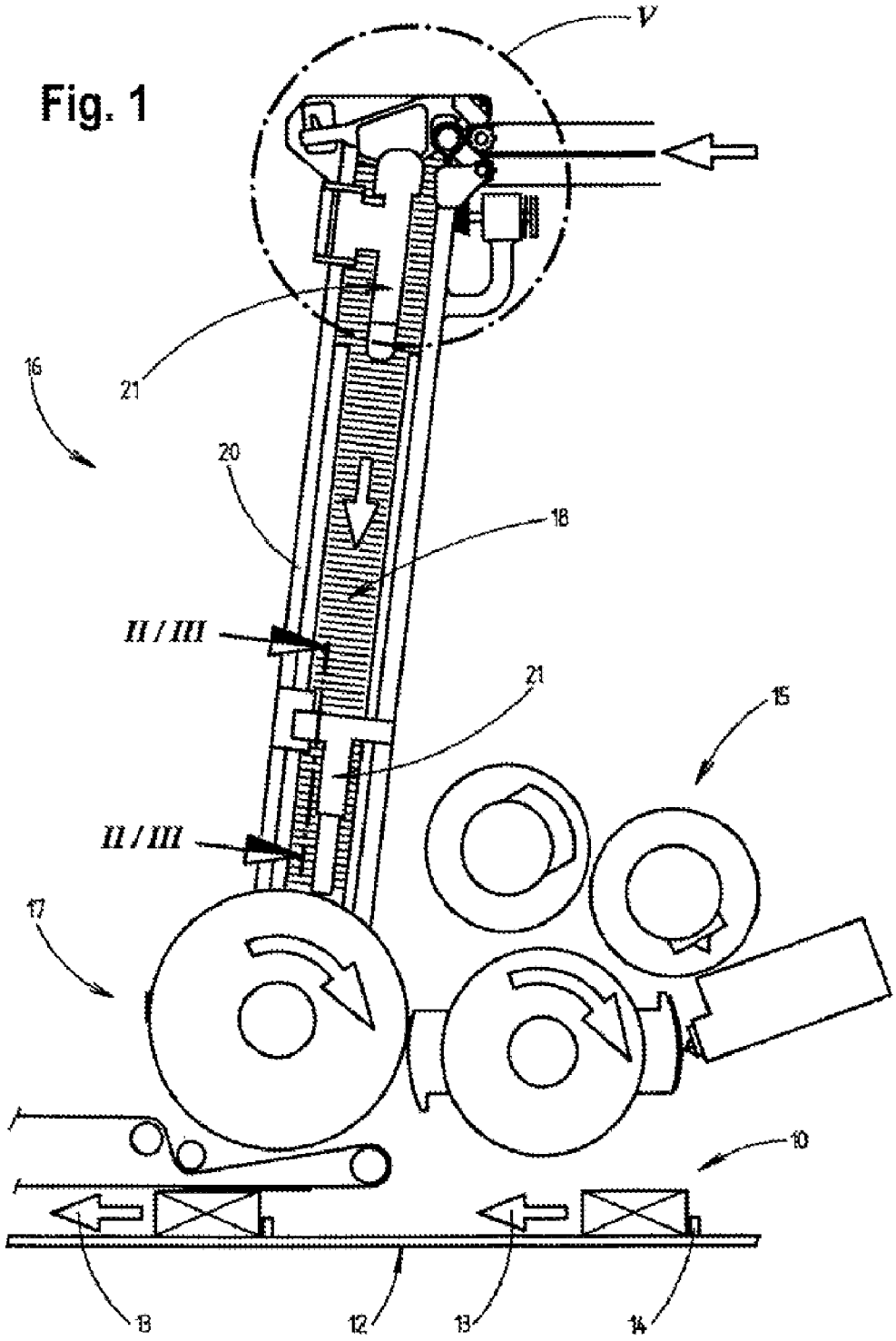
FIG. 1 shows a side view of a magazine for printing media.

As FIG. 1 shows, the brick-shaped packs 10 are transported continuously on a transport belt 12 in the conveying direction according to arrow 13 such that they lie flat and point in the conveying direction with one narrow side face. In this exemplary embodiment, the transport belt 12 has drivers 14 on the upper side which grip the rear side of the packs 10.

Above the transport belt 12 with the packs, a device is arranged for laying the printing media 11 on the packs 10. The device 15 can be configured according to DE 10 2006 001 800 A1 from the applicant, the complete contents of which are made part of the subject matter of the present description for the purpose of the complete disclosure of the invention.

The printing media 11 are removed from a magazine 16. A removing element 17 which operates below the magazine 16 serves for this purpose. In the present case, the removing element 17 is configured as a continuously rotating removing roll. The printing media 11 pass individually from the removing element 17 to the device 15 for laying the printing media 11 onto the packs 10.

The printing media 11 can preferably be tax or closure stamps of a cigarette pack. However, other blanks made from thin paper or another packaging material are also conceivable in principle, such as coupons or the like as a pack insert.

The printing media 11 are arranged in the magazine 16 so as to lie flat above one another to form a stack 18. The printing media 11 are removed from the magazine 16 by the removing element 17 on the underside of the stack 18 and are separated in the process.

A first special feature of the magazine 16 relates to measures for the improved removal and alignment of the printing media 11. For this purpose, the magazine 16 has a shaft 19 for receiving the stack 18 of printing media 11. The shaft 19 is delimited by walls 20 of the magazine or by guides 21. The cross-sectional dimensions of the shaft 19 are somewhat larger than the dimensions of the printing media 11, with the result that the latter are moved by their own weight in the upright magazine 16 or shaft 19 downwards to the removing element 17.

In order to prevent it being impossible for the printing media 11 to be separated by the removing element 17 as a result of an excessively high stack height or an excessively great friction between the printing media 11, there is provision for it to be possible for the printing media 11 to be held at defined points in the magazine 16. This takes place by means of vacuum, that is to say by loading the printing media 11 of the stack 18 in regions with vacuum. It has been shown that the printing media 11 can be placed close to one another by the loading with vacuum and can be held fixedly in the shaft 19. In this way, a relief of the (part) stack 18 which lies underneath can be achieved, as a result of which the correct removal of the printing media 11 is facilitated by means of the removing element 17.

In addition, a further advantage of this measure is that the printing media 11 can be aligned in the shaft 19 by the loading with negative pressure or vacuum, by being moved against one of the boundaries of the shaft 19 by the vacuum or the negative pressure. The printing media 11 which have been aligned in this way can be processed further in an improved manner, so that the result is that the positioning of the printing medium 11 on the pack 10 is improved.

In structural terms, the loading of the printing media 11 with negative pressure or vacuum is solved in such a way that one upright wall 20 of the magazine 16 has an opening 22, via which the printing media 11 can be loaded with a vacuum. Correspondingly, a vacuum line 23 which is connected to a vacuum device (not shown) is attached to the opening 22.

In the preferred exemplary embodiment shown, the opening 22 in the wall 20 opens into a plurality of slot-like depressions 24. The depressions 24 are aligned in the shaft 19 with their longitudinal direction parallel to the conveying direction of the printing media 11 and are distributed over the width of the wall 20. On account of the arrangement of the depressions 24 in the upright wall 20, air can be sucked out between the printing media 11 in order to form a compacted region of the stack 18 which can then be held fixedly on the wall 20 by the vacuum.

For reasons of linguistic simplification, the above-described device for loading parts of the stack 18 with vacuum is called suction device 25 in the following text. It goes without saying here that the suction device 25 does not have to be configured exclusively as described above. Structural alternative solutions which achieve the same or a comparable effect are also conceivable.

Figure 3:
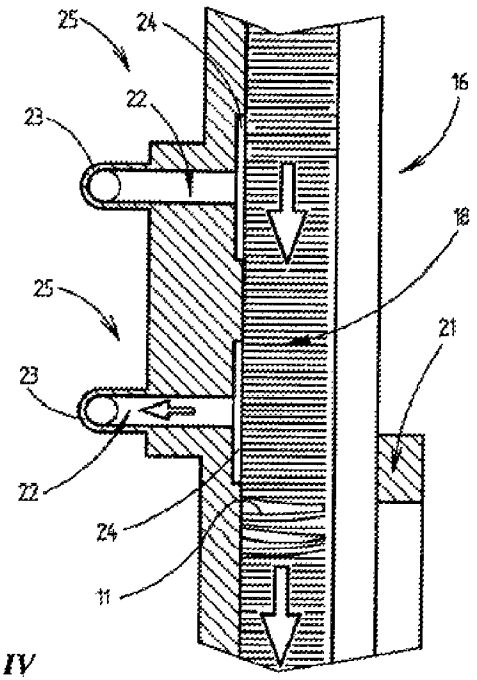
FIG. 3 shows a vertical section through the magazine along sectional line III-III in FIG. 1, in the case of activation of a second suction device.
Figure 2:
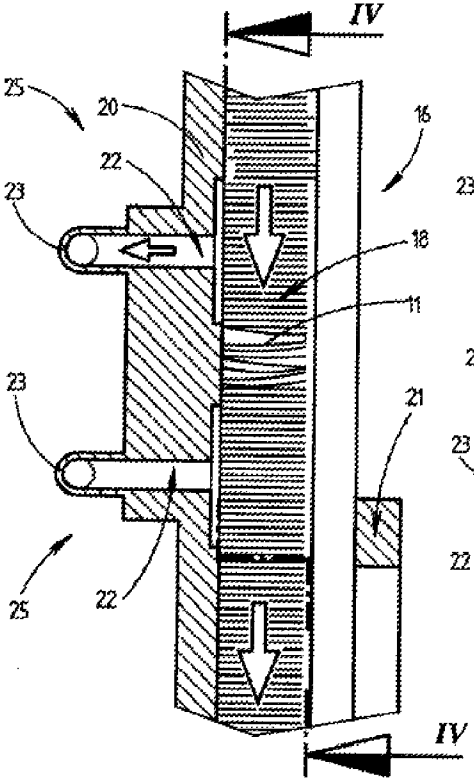
FIG. 2 shows a vertical section through the magazine along sectional line II-II in FIG. 1 in the case of activation of a first suction device.

As can be gathered from FIGS. 2 and 3, two suction devices 25 are arranged above one another in the region of the wall 20. The suction devices 25 are operated alternately, with the result that the stack 18 is held and aligned in the region of the upper or in the region of the lower suction device 25. In FIG. 2, the upper suction device 25 is activated and the lower suction device 25 is deactivated correspondingly. In FIG. 3, the upper suction device 25 is deactivated and the lower suction device 25 is activated. It has been shown that reliable operation of the apparatus is possible in this way. In the same way, more than two suction devices 25 which are arranged above one another at a spacing are of course also conceivable. For example, an adaptation of the number of suction devices 24 to the height of the magazine 16 is also conceivable.

As an alternative, only one suction device 25 can also be arranged in the region of the wall 20. In this case, it is considered necessary that the suction device 25 is operated in such a way that the stack 18 is not held completely on the wall 20 in this region, but rather that a certain amount of slip is allowed. This can be achieved by a corresponding selection of the strength of the vacuum. Since a control operation of this type is dependent on a very large number of factors, such as, in particular, stack height, printing-medium thickness and printing-medium weight, coefficient of friction of the printing medium, etc., the solution is preferred with a plurality of suction devices 25 which alternately hold the stack 18 fixedly on the wall 20.

A further solution for operating a magazine 16 with only one suction device 25 in the region of a wall 20 can comprise the fact that the suction device 25 is switched on and off in short intervals. The vacuum should therefore be so strong in each case that the stack 18 is held in each case in regions on the wall 20. This operating mode is of course also conceivable in principle in the case of a plurality of suction devices 25.

Figure 4:
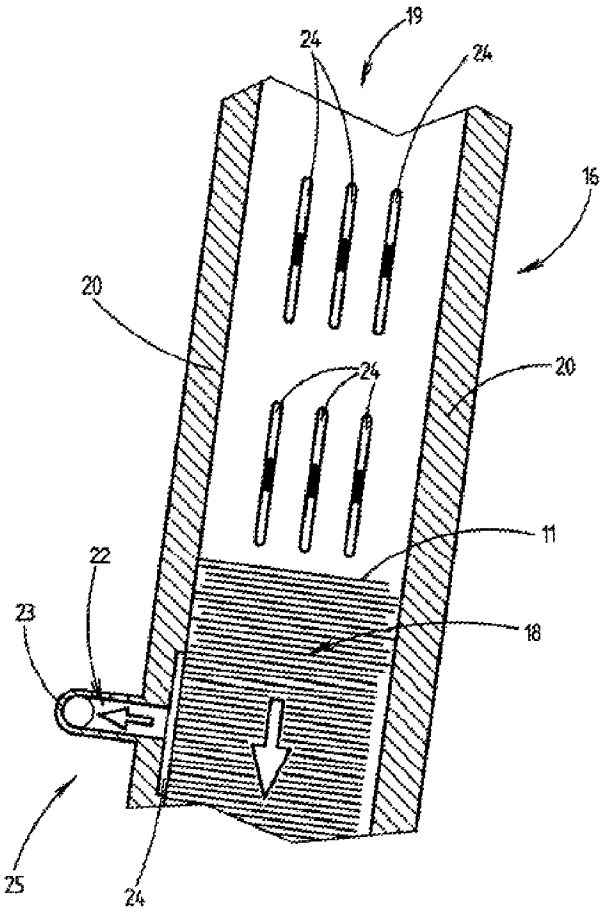
FIG. 4 shows a vertical section through the magazine along sectional line IV-IV in FIG. 2.

Furthermore, it is conceivable not only to arrange the suction device 25 or plurality of suction devices 25 on one wall 20, but also on another transversely directed wall 20 of the magazine 16. In this way, the stack 18 can be aligned in two directions on two walls 20 which extend transversely with respect to one another. A solution of this type is shown in FIG. 4.

In the present exemplary embodiment, the shaft 19 is delimited by three walls 20 which are arranged in a U-shape in cross section. The shaft 19 is open in the region of a front side and is delimited only in sections by the pivotable guides 21. As a result of the fact that the guides 21 are pivotable, the contents, that is to say the stack 18, can be accessed through the open front side of the shaft 19 in the case of disruptions. Another construction of the shaft 19 is of course also conceivable.

Figure 5:
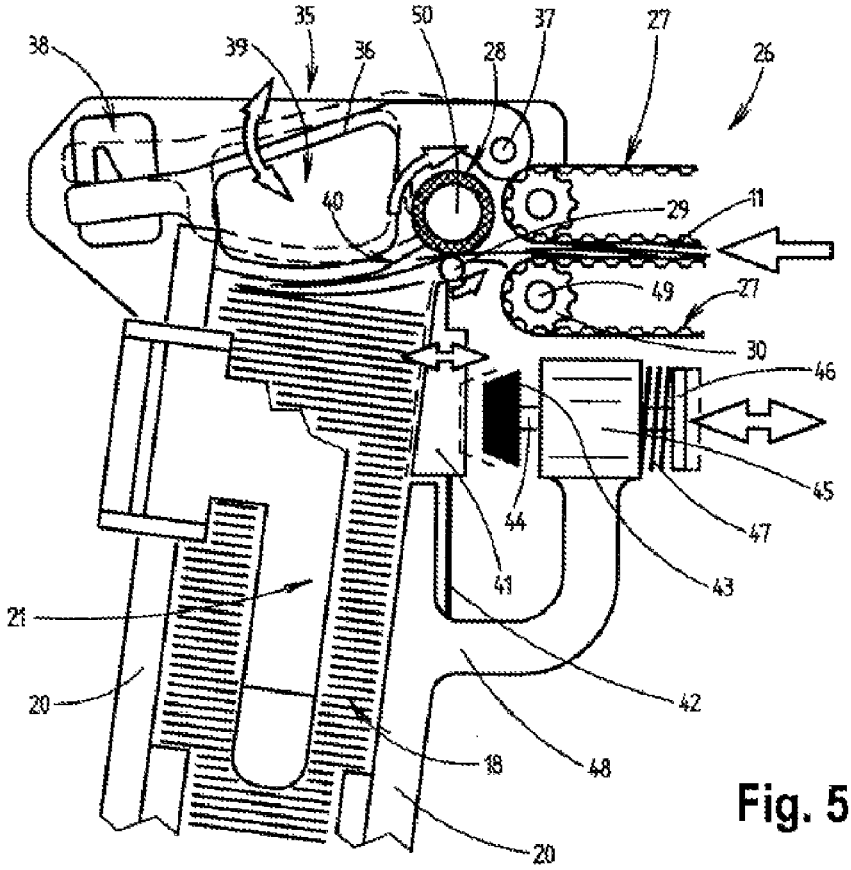
FIG. 5 shows a detail of the apparatus according to FIG. 1 in an enlarged partial illustration.
Figure 6:
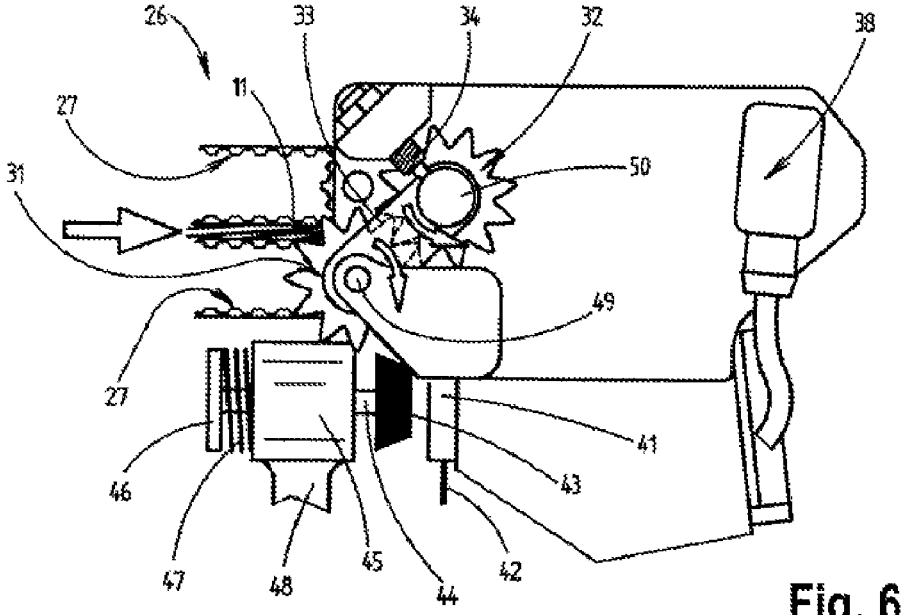
FIG. 6 shows a rear view of the detail according to FIG. 5 in a partial illustration.

Further special features of the exemplary embodiment shown are shown in FIG. 5 and FIG. 6:

The printing media 11 are fed to the magazine 16 via a conveying device 26. In the present case, the conveying device 26 is formed by two toothed belts 27, between the conveying runs of which, which face one another, the printing media 11 are conveyed to the upper side of the magazine 16. However, the conveying device 26 can also be constructed in a different way.

The conveying device 26 ends with a spacing to the sides of and above the magazine 16. In the region above the wall 20 of the magazine 16, the printing media 11 pass into the operating region of a rotationally driven conveying means 28 which interacts with a further conveying means 29, which is mounted so as to corotate, and conveys the printing media 11 into the magazine 16 from above.

In the present case, the first conveying means 28 is a rotationally driven conveying roll, preferably in the form of a rubber roller which interacts with the second conveying means 29 in the form of a roller. As a result of the arrangement of the conveying roll and the roller above the wall 20, the printing media 11 are laid reliably on the stack 18 in the magazine 16.

A further special feature comprises the drive of the conveying means 28. The conveying means 28 or the conveying roll is coupled to the drive for the toothed belts 27. To this end, the deflection wheel 30 of the lower toothed belt 27 in FIG. 5 is coupled to a gearwheel 31. The gearwheel 31 meshes in turn with a second gearwheel 32 which is coupled to the conveying roll. For example, the deflection wheel 30 and the gearwheel 31, and the gearwheel 32 and the conveying roll can be mounted in each case on common axles 49, 50.

A further special feature relates to the setting of the contact pressure of the two conveying means 28, 29. The conveying roll 28 is mounted on a pivoting arm 33 which is prestressed via a spring 34 or a spring means. The contact pressure of the rubber roller on the revolving roller can be set by adaptation of the spring means.

A further special feature relates to the control of the feed speed of the conveying device 26 and/or checking the height of the stack 18 in the shaft 19. A measuring device 35 serves for this purpose. The measuring device 35 has a sensor 36 which rests on the upper side of the stack 18. In the present case, the sensor 36 is mounted such that it can be pivoted about an axle 37, with the result that the sensor 36 rests on top of the stack 18 in the manner of a float. The sensor 36 is additionally coupled to a position transmitter 38 which detects the position of the sensor 36 and therefore the height of the stack 18. FIG. 5 shows two positions of the sensor 36 using continuous and dashed lines for clarification. In the present case, the sensor 36 is a plate-like structure which has a central recess 39 for weight reasons. An underside 40 of the sensor 36 is of rounded configuration, to be precise in the direction of the two conveying means 28, 29, in order that the printing media 11 can be pushed under the sensor 36.

The feed or conveying speed of the conveying device 26 is regulated according to the filling level of the magazine 16, which filling level is detected via the sensor 36 or the position transmitter 38. The regulation can preferably take place continuously. A graduation of the conveying speed in a plurality of discrete steps is also conceivable.

Gaps in the conveying stream of the printing media 11 and an excessively low filling level of the magazine 16 are avoided by adaptation of the conveying speed, that is to say gradual increase or decrease as a function of the filling level of the magazine 16. Both can cause faulty settings during feeding of the printing media 11.

A further special feature relates to measures for aligning the printing media 11 immediately after the latter are fed to the magazine 16. To this end, an upper section 41 of the wall 20 is mounted in a sprung manner, for example via a spring plate 42 on the wall 20. This section 41 is set oscillating, in order to align the printing media 11 in this region. In the present case, this takes place by way of a rubber buffer 43 which is mounted on an axle 44. The axle 44 extends through a coil 45 and is provided on the rear side with a plate-like end piece 46. In addition, a spring 47 is also positioned on the axle 44 between the rear-side end of the coil 45 and the end piece 46. In this way, an axial to and fro movement of the rubber buffer 43 is generated which sets the upper section 41 of the wall 20 oscillating. The coil 45 is mounted on the wall 20 via a carrying arm 48.

It goes without saying that the above-described special features can be realized cumulatively and/or as alternatives.

LIST OF DESIGNATIONS

10 Pack
11 Printing medium
12 Transport belt
13 Arrow
14 Driver
15 Device
16 Magazine
17 Removal element
18 Stack
19 Shaft
20 Wall
21 Guide
22 Opening
23 Vacuum line
24 Depression
25 Suction device
26 Conveying device
27 Toothed belt
28 Conveying means
29 Conveying means
30 Deflection wheel
31 Gearwheel
32 Gearwheel
33 Pivoting arm
34 Spring
35 Measuring device
36 Sensor
37 Axle
38 Position transmitter
39 Recess
40 Underside
41 Section
42 Spring plate
43 Rubber buffer
44 Axle
45 Coil
46 End piece
47 Spring
48 Carrying arm
49 Axle
50 Axle

What is claimed is:

1. An apparatus for handling stacks (18) of printing media (11) which are arranged above one another and are made from packaging material, in particular a magazine (16) for excise stamps or coupons, within an apparatus for producing packs (10) for cigarettes, the apparatus having a shaft (19) for receiving the stack (18), which shaft (19) is delimited at least partially by stationary walls (20) and is upright, wherein the shaft (19) has at least one suction device (25) which acts in regions on the stack (18) in order to hold and/or align the printing media (11) on at least one of the stationary walls (20) by means of vacuum.

wherein the printing media (11) are arranged in the stack (18) so as to lie flat on one another, and wherein edges of the printing media (11) face the at least one of the stationary walls (20) of the shaft (19), with the result that the suction action of the at least one suction device (25) acts on an edge of the printing media (11).

2. The apparatus according to claim 1, wherein the suction device (25) is assigned to at least one of the stationary walls (20) of the shaft (19) in such a way that at least one opening (22) is provided in the at least one of the stationary walls (20), which opening (22) is connected to a vacuum source and via which opening (22) the stack (18) can be loaded with a vacuum in the region of the opening (22).

3. The apparatus according to claim 1, wherein the at least one of the stationary walls (20) has two suction devices (25) which are spaced apart from one another and can be actuated alternately by means of a controller.

4. The apparatus according to claim 1, wherein the shaft (19) has at least two of the stationary walls (20), and in that the at least one suction device (25) is provided on both of the stationary walls (20) for aligning the stack (18) in two directions transversely with respect to one another.

5. An apparatus for handling stacks (18) of printing media (11) which are arranged above one another and are made from packaging material, in particular a magazine (16) for excise stamps or coupons, within an apparatus for producing packs (10) for cigarettes, the apparatus having a shaft (19) for receiving the stack (18), which shaft (19) is delimited at least partially by walls (20) and is upright, a conveying device (26) for feeding the printing media (11) to the shaft (19), and a measuring device (35) for detecting the height of the stack (18), wherein the speed of the conveying device (26) is regulated according to the height of the stack (18) detected by the measuring device (35), in order to control the height of the stack (18).

6. The apparatus according to claim 5, wherein at least one region (41) of at least one of the walls (20) of the shaft (19) is of movable configuration for aligning the stack (18), the at least one of the walls (20) being set in vibration by an oscillation device.

7. The apparatus according to claim 5, wherein, in order to transfer the printing media (11) from the conveying device (26) to the shaft (19), a rotationally driven conveying means (28) is arranged in the conveying path of the printing media (11), the conveying means (28) being coupled to a drive of the conveying device (26).

8. The apparatus according to claim 7, wherein the conveying means (28) is assigned a further conveying means (29) which is mounted so as to corotate, with the printing media (11) being conveyed through between the conveying means (28, 29).

9. The apparatus according to claim 8, wherein the conveying means (28, 29) are brought into contact with one another by a spring device (34), the contact pressure being variable by adaptation of the spring device (34).

10. The apparatus according to claim 8, wherein the further conveying means (29) is arranged above the walls (20) of the shaft (19).

11. A method for handling stacks (18) of printing media (11) which are arranged above one another and are made from packaging material, in particular a magazine for excise stamps or coupons, within an apparatus for producing packs (10) for cigarettes, having a shaft (19) for receiving the stack (18), which shaft (19) is delimited at least partially by stationary walls (20) and is upright, comprising:

holding and/or aligning the printing media (11) of the stack (18) on at least one of the stationary walls (20) at least in regions by action of a vacuum on the corresponding printing media (11) via a suction device (25) which is assigned to the at least one of the stationary walls (20), and arranging the printing media (11) in the stack (18) so as to lie flat on one another, wherein edges of the printing media (11) face the at least one of the stationary walls (20) of the shaft (19), with the result that the suction action of the at least one suction device (25) acts on an edge of the printing media (11).

12. The method according to claim 11, wherein the at least one of the stationary walls (20) has a plurality of suction devices (25) which are operated alternately.

13. The method according to claim 11, further comprising, in order to align the printing media (11) within the stack (18), setting into oscillation the at least one of the stationary walls (20) of the shaft (19) at least in regions.

14. A method for handling stacks (18) of printing media (11) which are arranged above one another and are made from packaging material, in particular a magazine for excise stamps or coupons, within an apparatus for producing packs (10) for cigarettes, having a shaft (19) for receiving the stack (18), which shaft (19) is delimited at least partially by stationary walls (20) and is upright, comprising:

holding and/or aligning the printing media (11) of the stack (18) on at least one of the stationary walls (20) at least in regions by action of a vacuum on the corresponding printing media (11) via a suction device (25) which is assigned to the at least one of the stationary walls (20), feeding the printing media (11) via a conveying device (26) to the shaft (19), detecting the height of the stack (18) of the printing media (11) in the shaft (19) by means of a measuring device (35), and regulating the feed speed of the conveying device (26) according to the height of the stack (18).

* * * * *